US010952531B2

(12) United States Patent
Franz et al.

(10) Patent No.: US 10,952,531 B2
(45) Date of Patent: Mar. 23, 2021

(54) HEIGHT-ADJUSTABLE DEVICE

(71) Applicant: Lufthansa Technik AG, Hamburg (DE)

(72) Inventors: Felix Franz, Hamburg (DE); Johannes Insel, Hamburg (DE); Marcus Seidel, Hamburg (DE); Daniel Koch, Hamburg (DE); Sebastian Begemann, Hamburg (DE)

(73) Assignee: LUFTHANSA TECHNIK AG, Hamburg (DE)

( * ) Notice: Subject to any disclaimer, the term of this patent is extended or adjusted under 35 U.S.C. 154(b) by 0 days.

(21) Appl. No.: 16/699,128

(22) Filed: Nov. 29, 2019

(65) Prior Publication Data

US 2020/0170403 A1 Jun. 4, 2020

(30) Foreign Application Priority Data

Nov. 30, 2018 (EP) ..... 18209461

(51) Int. Cl.
*A47B 9/12* (2006.01)
*A47B 9/20* (2006.01)
*A47B 9/06* (2006.01)

(52) U.S. Cl.
CPC ..... *A47B 9/12* (2013.01); *A47B 9/06* (2013.01); *A47B 9/20* (2013.01); *A47B 2200/0052* (2013.01)

(58) Field of Classification Search
CPC .... A47B 9/12; A47B 9/06; A47B 9/20; A47B 2200/0052; A47B 2200/005; A47B 9/10; A47B 2200/0056; A47B 9/00
See application file for complete search history.

(56) References Cited

U.S. PATENT DOCUMENTS 4,619,208 A * 10/1986 Kurrasch ..... A47B 9/12 108/106
5,797,331 A * 8/1998 Watt ..... A47B 9/02 108/146

(Continued)

FOREIGN PATENT DOCUMENTS

| | | | |
|---|---|---|---|
| CN | 108497695 | A | 9/2018 |
| DE | 202006012066 | U1 | 10/2006 |
| EP | 1987734 | B1 | 12/2010 |

*Primary Examiner* — Hanh V Tran
(74) *Attorney, Agent, or Firm* — Leydig, Voit & Mayer Ltd.

(57) ABSTRACT

A height-adjustable device has synchronously height-adjustable lifting devices each having a standing and lifting element, which are height-adjustable relative thereto. The height adjustment is configured to be carried out via pulling elements, formed by redirection devices, to raise the lifting element relative to the standing element. Each pulling element is secured in a non-positive or positive locking manner to lifting devices, and each are configured such that a lengthening in the region of the first lifting device brings about a synchronous shortening in the region of the second lifting device. Each pulling element is constructed to raise only the one lifting element relative to the standing element. The height-adjustable device has a locking device that locks the pulling elements by a non-positive or positive locking engagement on the corresponding one of the pulling elements. The locking device is constructed to synchronise the movement of the pulling elements.

15 Claims, 7 Drawing Sheets

(56) References Cited

U.S. PATENT DOCUMENTS

| | | | | |
|---|---|---|---|---|
| 5,941,182 | A * | 8/1999 | Greene | A47B 9/12 108/147 |
| 6,152,049 | A * | 11/2000 | Schmidt | A47B 9/12 108/147 |
| 9,038,549 | B1 * | 5/2015 | Zebarjad | A47B 9/02 108/147 |
| 2005/0179196 | A1 * | 8/2005 | Bolza-Schunemann | B65H 9/105 271/226 |
| 2009/0320206 | A1 * | 12/2009 | Dyreby | B66F 3/00 5/611 |
| 2010/0187380 | A1 * | 7/2010 | Koder | A47B 9/04 248/188.5 |
| 2012/0227642 | A1 * | 9/2012 | Sekikawa | A47B 9/10 108/147 |
| 2014/0096706 | A1 * | 4/2014 | Labrosse | F16L 3/01 108/21 |
| 2015/0059501 | A1 * | 3/2015 | Perabo | B66D 1/14 74/89.16 |
| 2015/0320198 | A1 * | 11/2015 | Zebarjad | A47B 9/20 108/147 |
| 2016/0037907 | A1 * | 2/2016 | Ergun | A47B 9/02 108/147 |
| 2016/0227921 | A1 * | 8/2016 | Hansen | A47B 9/02 |
| 2016/0245386 | A1 * | 8/2016 | Rossberger | B62M 23/00 |
| 2016/0296005 | A1 * | 10/2016 | Stoelinga | F16M 11/046 |
| 2018/0064241 | A1 * | 3/2018 | Tseng | F15B 15/1409 |
| 2018/0092457 | A1 * | 4/2018 | Lai | A47B 9/20 |
| 2018/0128352 | A1 * | 5/2018 | Scholzen | F16H 7/02 |

* cited by examiner

HEIGHT-ADJUSTABLE DEVICE

CROSS-REFERENCE TO PRIOR APPLICATIONS

Priority is claimed to European Patent Application No. EP 18 209 461.5, filed on Nov. 30, 2018, the entire disclosure of which is hereby incorporated by reference herein.

FIELD

The present invention relates to a height-adjustable device.

BACKGROUND

Height-adjustable devices, in particular lifting tables, are used, for example, in the office sector or in aircraft, in particular VIP aircraft. Generally, such lifting tables have two lifting columns. During the height adjustment of such a device, it may be problematic to synchronise the lifting movement between two or more lifting devices, and to lock at the desired height without torsion or other problems arising. It may be problematic, in particular, with corresponding tables in VIP aircraft in which the height adjustment is generally carried out from the front ends of the table by cabin crew. In this instance, there is generally produced a non-uniform application of force to the lifting pillars.

A lifting device of the above-mentioned type is disclosed in EP 1 987 734 B1.

SUMMARY

In an embodiment, the present invention provides a height-adjustable device that has at least two synchronously height-adjustable lifting devices, which each have a standing element and a lifting element, which are height-adjustable relative thereto. The height adjustment is configured to be carried out via pulling elements, which are formed by redirection devices to raise the corresponding lifting element relative to the associated standing element. Each of the pulling elements is secured in a non-positive-locking manner and/or a positive-locking manner to two of the lifting devices, and each are configured such that a lengthening in the region of the first lifting device brings about a synchronous shortening in the region of the second lifting device. Each of the pulling elements is constructed to raise only the one lifting element relative to the associated standing element. The height-adjustable device has a locking device configured to lock each of the pulling elements by a non-positive-locking engagement and/or a positive-locking engagement on the corresponding one of the pulling elements. The locking device is constructed to synchronise the movement of the pulling elements.

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1A:
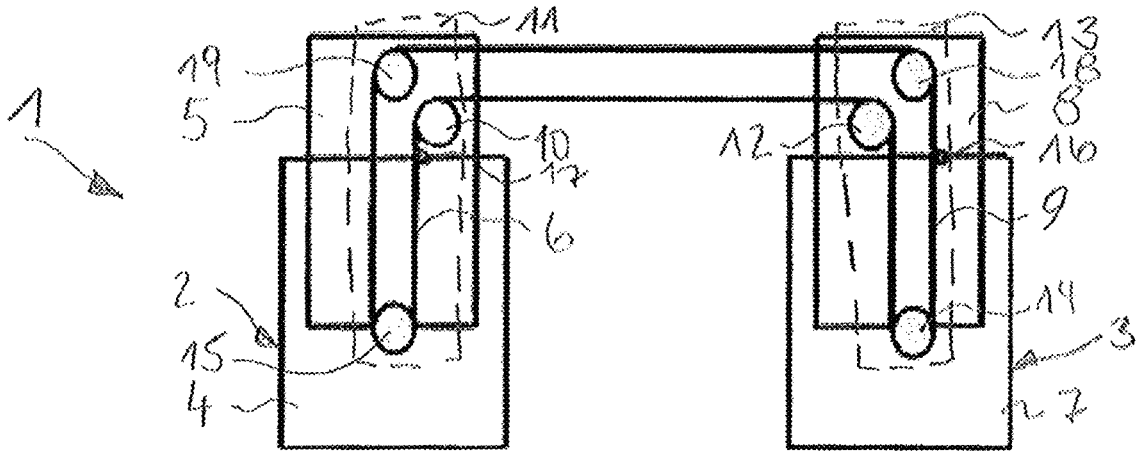
FIGS. 1*a*, 1*b* are schematic illustrations of a basic principle of the height adjustment, as used in an exemplary height-adjustable device according to an embodiment of the present invention.

Embodiments of the present invention provide an improved lifting device that facilitates a synchronous height adjustment, enables a secure locking at the desired height and is constructed in a simple manner.

Embodiments of the present invention achieve the above-described advantageous features by providing a locking device for locking each pulling element by non-positive-locking and/or positive-locking engagement on the pulling element and the locking device is additionally constructed to synchronise the movement of the pulling elements.

The invention relates to a height-adjustable device having at least two synchronously height-adjustable lifting devices which each have a standing element and a lifting element which can be height-adjusted relative thereto, where the height adjustment is carried out by means of pulling elements, which are formed by means of redirection devices to raise each lifting element relative to the associated standing element; where each pulling element is secured in a non-positive-locking or positive-locking manner to two lifting devices and a lengthening in the region of the first lifting device brings about a synchronous shortening in the region of the second lifting device; and each pulling element is constructed to raise only one lifting element relative to the associated standing element.

Firstly, some of the terms used in the context of the present disclosure will be explained.

A height-adjustable device may, according to an embodiment of the present invention, in particular, include an item of furniture or a furnishing item, e.g., tables, work surfaces, or the like.

The device stands on the installation surface with the standing elements. It may, for example, be table legs or the components thereof, which are non-movable with respect to the installation surface.

A lifting element can be height-adjusted relative to each standing element. The lifting elements carry, for example, a table top or the like.

Pulling elements in the context of embodiments of the invention can transmit the pulling forces required for the height adjustment, they may, for example, be preferably flexible belts, bands, chains or the like. By means of redirection devices, they are constructed to lift each lifting element relative to the associated standing element. The redirection devices, preferably redirection rollers, can be used both purely for force redirection of the pulling elements and for the lifting operation in the sense of a pulley. For example, according to an embodiment of the invention, a redirection device may be arranged in the lower region of a lifting element, by means of this redirection device there is a lifting in the sense of a pulley by means of a pulling element which is redirected around it through approximately 180°.

Each pulling element is secured in a non-positive-locking and/or positive-locking manner to two lifting devices. Preferably, the securing is carried out with each end of a pulling element to the static regions (standing element) of a lifting device in each case. The kinematics is configured in such a manner that a lengthening in the region of the first lifting device brings about a synchronous shortening in the region of the second lifting device. This synchronises, as will be explained in greater detail below, the lifting movements of two lifting devices.

Each pulling element is constructed to lift only one lifting element relative to the associated standing element. Two lifting devices are thus, according to an embodiment of the invention, connected to each other by means of at least two pulling elements, each of these pulling elements is (preferably by means of redirection rollers) constructed to lift only one lifting element by means of shortening in the region of this lifting element. The two pulling elements cooperate with each other by means of mutually opposing movement and bring about the lifting movement of both lifting elements and the synchronisation of this movement.

According to an embodiment of the invention, there is provision for a locking device to be provided for locking each pulling element by means of non-positive-locking and/or positive-locking engagement on this pulling element. As a result of the locking of each pulling element, the further movement of these pulling elements and consequently also the lifting movement of the lifting device are blocked or locked.

In the device according to an embodiment of the invention, the pulling elements consequently have the dual function, on the one hand, of synchronising the lifting movement and, on the other hand, locking the adjusted height adjustment by these pulling elements themselves being blocked by the locking device, according to an embodiment of the invention. According to an embodiment of the invention, separate locking arrangements which are often susceptible to malfunction are not required in the lifting devices themselves.

The locking device, according to an embodiment of the invention, is additionally constructed in such a manner that the movement of the pulling elements is carried out synchronously. This means that the locking device kinematically couples the generally mutually opposing movements of, for example, two pulling elements by means of corresponding devices in this locking device in such a manner that a movement of a pulling element in one direction preferably brings about an opposing synchronous movement of the second pulling element. This synchronisation by the locking device is preferably provided in addition to the synchronisation by the kinematics of the connection of the pulling elements to standing elements and lifting elements and improves operation and in particular a uniform lifting movement of the device, according to an embodiment of the invention. In particular, such a synchronisation may be provided by the locking device when it is constructed to drive the pulling elements.

According to an embodiment of the invention, it is preferable for each pulling element to be connected with each end in a non-positive-locking manner to one standing element; and to be guided in the region of a lifting device by means of a pulley which is arranged on the lifting element. The shortening of the pulling element in the region of the lifting element with the pulley lifts the corresponding lifting element, the synchronous lengthening of the pulling element in the region of the second lifting device is preferably used in the manner illustrated below in the embodiments via redirection rollers which are arranged in the upper region of the lifting element of the second lifting device and consequently also forcibly synchronises the lifting movement of this second lifting element by preventing an excessively powerful lifting of this second lifting element since an additional lengthening of the pulling element would then be required.

According to an embodiment of the invention, it is preferable for the locking device to be constructed for the non-positive and/or positive-locking engagement on each pulling element in the region of the guide of these pulling elements between the lifting devices. In particular, it may be constructed, according to an embodiment of the invention, as a central unit which can lock all the pulling elements in a region centrally between the lifting devices (table legs). The locking only in a central unit significantly facilitates the handling and operation. In particular, it is not required, according to an embodiment of the invention, to provide separate locking arrangements in the individual lifting devices and where applicable complex devices for distributing a locking signal over a plurality of locking devices in these lifting devices. A central locking further brings about a uniform force distribution over the different lifting devices.

The locking device may additionally be constructed to drive the pulling elements. It can consequently be constructed for manual or motorised driving of at least one, preferably all of the pulling elements so that, by actuating the drive, a height adjustment is carried out. In this embodiment of the invention, the pulling elements consequently serve not only to synchronise the lifting movement, whilst the pulling force is applied, for example, by pressing or pulling on the table top. Instead, they additionally serve to activate directly the lifting devices.

According to an embodiment of the invention, the locking device may have a shaft (preferably with a toothed wheel, friction wheel or the like placed thereon) for the non-positive-locking and/or positive-locking movement, locking and synchronisation of the pulling elements. The term shaft refers to an element which as a result of a rotation may bring about a corresponding longitudinal movement of the pulling element or the pulling elements. Between the shaft (or toothed wheel or friction wheel) and pulling element there may be a non-positive-locking or frictionally engaging connection, but preferably for the synchronisation of the movements there is, according to an embodiment of the invention, a positive-locking connection.

According to an embodiment of the invention, it is therefore particularly preferable for the pulling elements to have toothed belts and the shaft to have toothed wheels which mesh therewith. In this instance, there may be provision, according to an embodiment of the invention, for the locking of the pulling elements to be carried out by blocking a rotational movement of the shaft. Toothed wheels or friction wheels, which are placed on the shaft may, for example, be connected to the shaft by means of a feather key connection.

In order to secure the non-positive-locking connection and/or positive-locking connection between the shaft and pulling elements, in the region of the forward offset and/or backward offset of the pulling elements relative to the shaft, additional redirection rollers may be provided. These redirection rollers may, for example, result in toothed belts being guided over a sufficiently large peripheral portion of the shaft and consequently a secure positive-locking and/or non-positive-locking connection being produced. The redirection rollers may be supported so as to freely rotate on an axle, that is to say, not kinematically coupled to the above-described shaft. Alternatively, they may be connected to the shaft in a rotationally secure manner. The rotationally secure connection is carried out in this instance preferably not only via the pulling elements, for example, toothed belts, but in addition by means of a suitable kinematic connection, such as, for example, toothed wheels or the like.

Preferably, the pulling elements are constructed in such a manner that during operation under provided operating conditions they are not subjected to any significant lengthening. No significant lengthening means that any expansion/lengthening does not impair the operation of the lifting device and the synchronisation of the lifting movement. The pulling elements may be produced from appropriately tension-resistant material or have reinforcement elements. For example, toothed belts may be provided with steel cords.

The device according to an embodiment of the invention may be provided with two lifting devices, for example, as a table with two lifting columns. Such an embodiment may, for example, be used as a table in cars or aircraft, for example, VIP aircraft. The device according to an embodiment of the invention may preferably be constructed as a table regardless of the number of lifting devices.

In the embodiment as a table, the locking device is preferably constructed as a central unit below the table top between the lifting devices (table legs or lifting columns).

The device according to an embodiment of the invention may have at least one device for receiving lifting loads. For example, there may be arranged in the lifting devices gas pressure springs which, for example, substantially compensate for the weight force of the height-adjustable component of the device, or slightly overcompensate therefor. This facilitates a manual height adjustment and/or enables a height adjustment by driving the pulling elements by applying smaller forces.

Figure 1B:
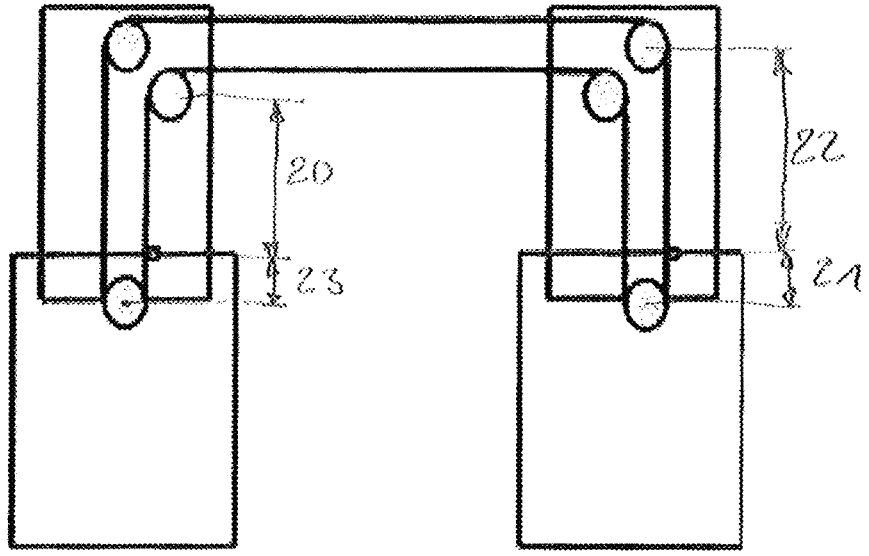

Using FIGS. 1*a* and 1*b*, a basic principle of a height adjustment, as used according to an embodiment of a device 1 according to the invention, will be set out below. The explanation is carried out according to the embodiment with a first lifting device 2 and a second lifting device 3. The first lifting device 2 includes a first standing element 4 and a first lifting element 5 which can be moved into and out of the first standing element 4, and in addition a first pulling element 6. In a similar manner, the second lifting device includes a second standing element 7, a second lifting element 8 and a second pulling element 9. The first pulling element 6 is connected in the first lifting device 2 to the first standing element 4 at the first connection location 17 and is guided vertically upwards and guided via a first front redirection roller 10 of a first redirection device 11 horizontally to a second front redirection roller 12 of a second redirection device 13 of the second lifting device 3 and there via the second front redirection roller 12 guided vertically downwards and via a lower redirection roller 14 upwards again and connected to the second standing element 7 at the second connection location 16. In a similar manner to the first pulling element 6, the second pulling element 9 is connected to the second standing element 7 at the second connection location 16 and is guided vertically upwards to a second rear redirection roller 18 and from there horizontally to a first rear redirection roller 19. In the first lifting device 2, the second pulling element 9 is guided from the first rear redirection roller 19 vertically downwards to a first lower redirection roller 15, from there guided upwards and connected to the first standing element 4 at the connection location 17.

A height adjustment is carried out by means of a movement of the first and/or second pulling element 6, 9. The movement is triggered by the action of force on the pulling elements 6, 9. In this instance, two variants are possible. In one variant, a pulling element is acted on with a force. This leads to a movement of the pulling element and the movement sequence described below. According to a second variant, force is applied to both pulling elements at the same time so that a mutually opposing movement of the pulling elements is triggered synchronously. The movement sequences described below of the pulling elements 6, 9 are then carried out synchronously.

A movement of the second pulling element 9 to the left leads, as a result of the connection of the second pulling element 9 to the second standing element 7, to a lifting of the second lifting element 8. The lifting of the second lifting element 8 leads to a lengthening of the distance 20 between the first front redirection roller 10 and the first connection location 17 and a synchronous shortening between the second connection location 16 and the second lower roller 14. At the same time, there is produced a lengthening 22 between the second rear redirection roller 18 and the second connection location 16, which leads to a synchronous shortening 23 between the first connection location 17 and the first lower redirection roller 15 of the first lifting device 2, where the first lifting element 5 as a result of the shortening of the distance 23 from the first pulling element is pulled upwards, that is to say, raised. A movement of the first pulling element 6 to the right would result in a similar movement sequence.

A movement of the second pulling element 9 to the right leads to a lowering of the first and second lifting elements 5, 8 since, in this manner, the distance 20 in the first lifting device is shortened. The shortening of the distance 20 results in the first lifting element 5 being pulled back by the second pulling element 9 into the first standing leg 4, that is to say, being lowered. At the same time, there is produced a lengthening of the distance 23 in the first lifting device 2. The lengthening of the distance 23 leads to the distance 22 being shortened, whereby in turn the second lifting element 8 is pulled into the second standing element 7, that is to say, is also lowered. It is also the case in this instance that a movement of the first pulling element 6 to the right results in a similar movement sequence of the lifting devices 2, 3.

Figure 2:
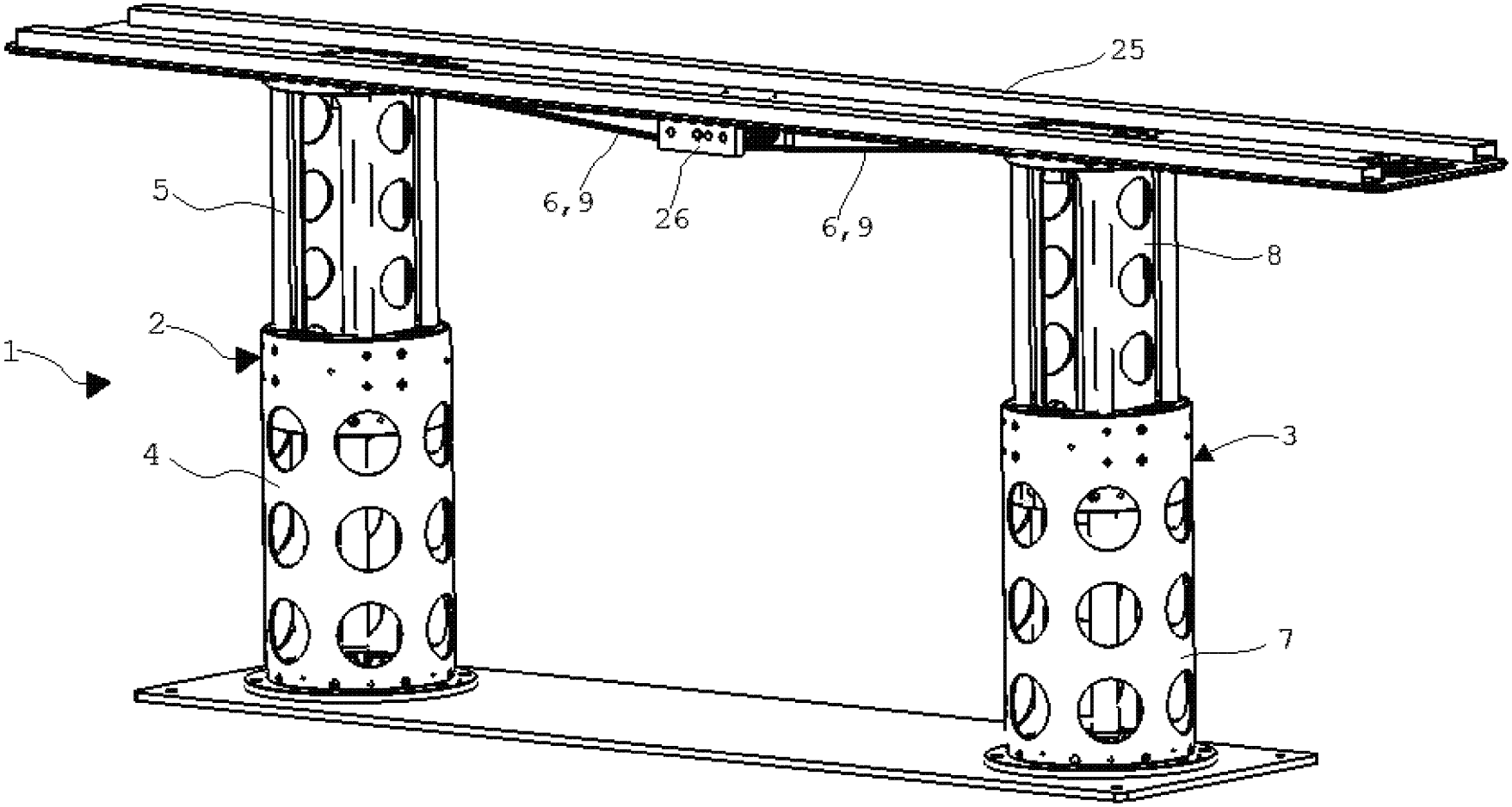
FIG. 2 is a schematic illustration of an embodiment of a device according to the invention.

A first embodiment of a height-adjustable device 1 according to the invention is illustrated in FIG. 2. The device illustrated includes a first lifting device 2 having a first standing element 4 and a lifting element 5. Furthermore, the device includes a second lifting device 3 which includes a second standing element 7 and a second lifting element 8. With both lifting devices 2, 3, the lifting elements 5, 8 can be moved into the standing elements 4, 7 and out again and vice versa. There is arranged on the lifting devices 2, 3 a cross-member 25 which connects the lifting devices 2, 3 to each other.

In addition to the schematic illustration of the basic principle, the device 1 according to the embodiment has a locking device 26 through which both pulling elements 6, 9 are guided and which is constructed in such a manner that it is able to produce a locking of the movement of the pulling elements 6, 9. The locking device 26 is arranged centrally on the cross-member 25 between the two lifting devices 2, 3. As a result of the central arrangement of the locking device 26 between the lifting devices 2, 3, the path lengths between the lifting devices are of equal length, whereby a synchronous transmission of the tensile forces which occur to the lifting devices 2, 3 is achieved, which in turn results in the lifting elements 5, 8 being moved upwards or downwards at the same time and a tilting action being prevented. In the locked state, with a one-sided loading a tilting action can also be reliably prevented by the synchronous transmission of the tensile forces.

Figure 3:
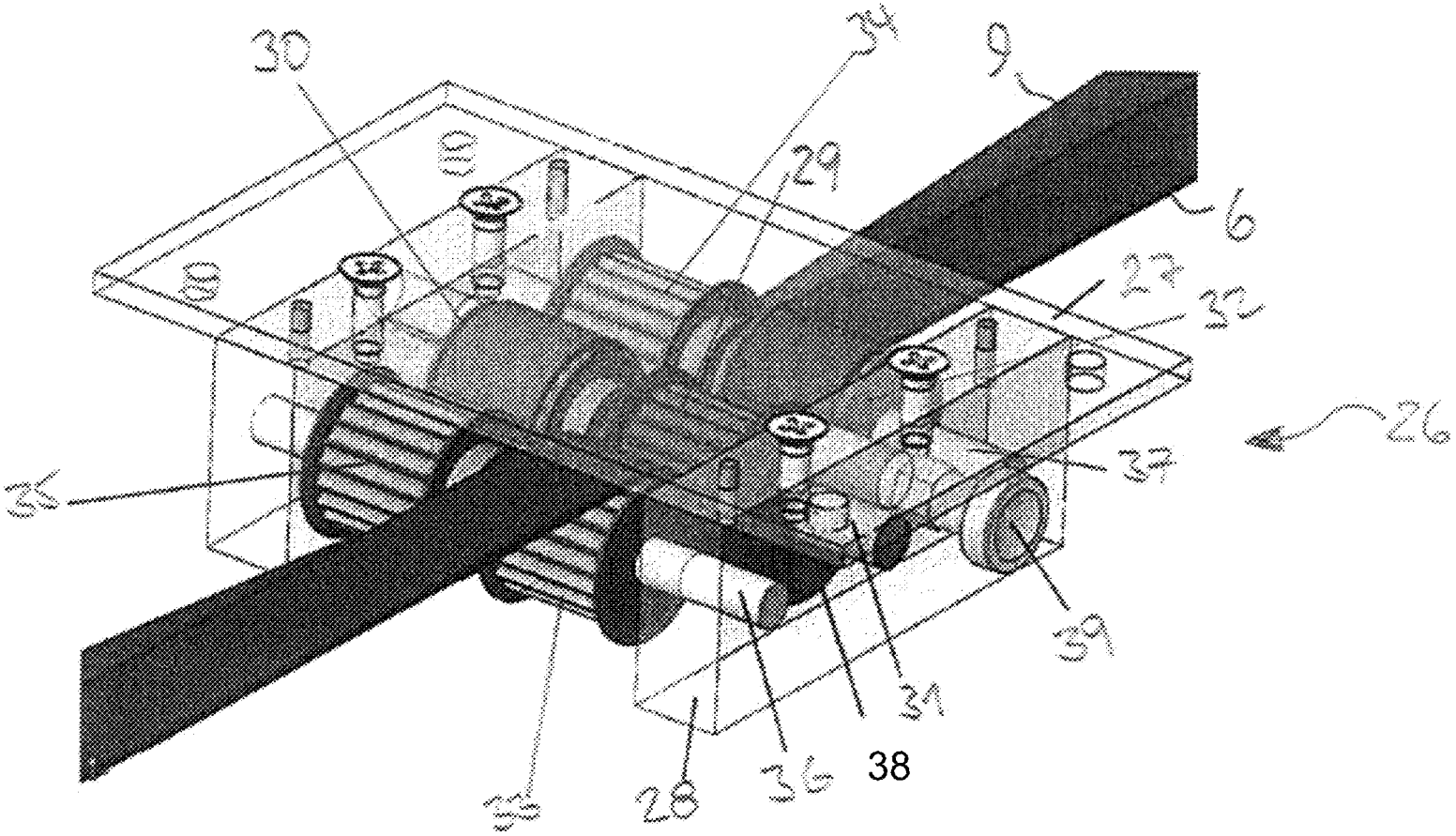
FIG. 3 is a schematic illustration of an embodiment of a locking device.

FIG. 3 shows a possible embodiment of a locking device 26 according to the invention. The locking device 26 includes a covering plate 27, via which the locking device 26 can be secured to the cross-member 25 and two side portions 28. The first and second pulling elements 6, 9 are guided centrally in each case via a first and a second central redirection roller 29, 30 through the locking device 26. The central redirection rollers 29, 30 are connected to a central shaft 31 in a rotationally secure manner. In addition, for each pulling element 6, 9 in front of and behind the central redirection rollers 29, 30 lateral redirection rollers 32, 33, 34, 35 are provided, where the adjacent lateral redirection rollers 32, 34 and 33, 35 are in each case arranged in a state movably supported on a common axle 36, 37. In order to enable the required mutually opposing movement direction of the pulling elements 6, 9, the first pulling element 6 is guided over the lower side of the first central redirection roller 29 and the second pulling element 9 is guided over the upper side of the second central redirection roller 30. The guiding via the lateral redirection rollers 32, 33, 34, 35 is accordingly adapted. The movement of the pulling elements 6, 9 is preferably carried out by means of a rotation of the central shaft 31, which for this purpose may be connected to an electric motor or a crank (both not illustrated).

The central shaft 31 can be blocked in different positions. In the embodiment illustrated, there is secured to the central shaft 31 a locking plate 38 on the periphery of which there are provided various holes into which a resiliently loaded locking pin 39 can be guided for the purposes of locking. The locking pin is secured in a side portion 28 of the locking device 26 and is placed as a result of the resilient force in the next hole. Via a Bowden cable or a rod system, it is possible to release or place the locking pin 39 from other positions (for example, end face of the table top).

The pulling elements 6, 9 may be constructed as toothed belts. It is possible to use as toothed belts, for example, a toothed belt from the manufacturer Madler GmbH which is provided with an HTD profile. This profile is distinguished by the use in high-performance belts, ensures a belt drive with low backlash. A TPU belt was selected (thermoplastic polyurethane) with steel tension cord (see: http://www.maedler.de/product/1643/1616/945/zahnriemen-meterware-pu-profil-htd). The redirection rollers are accordingly constructed as toothed belt wheels.

Figure 4:
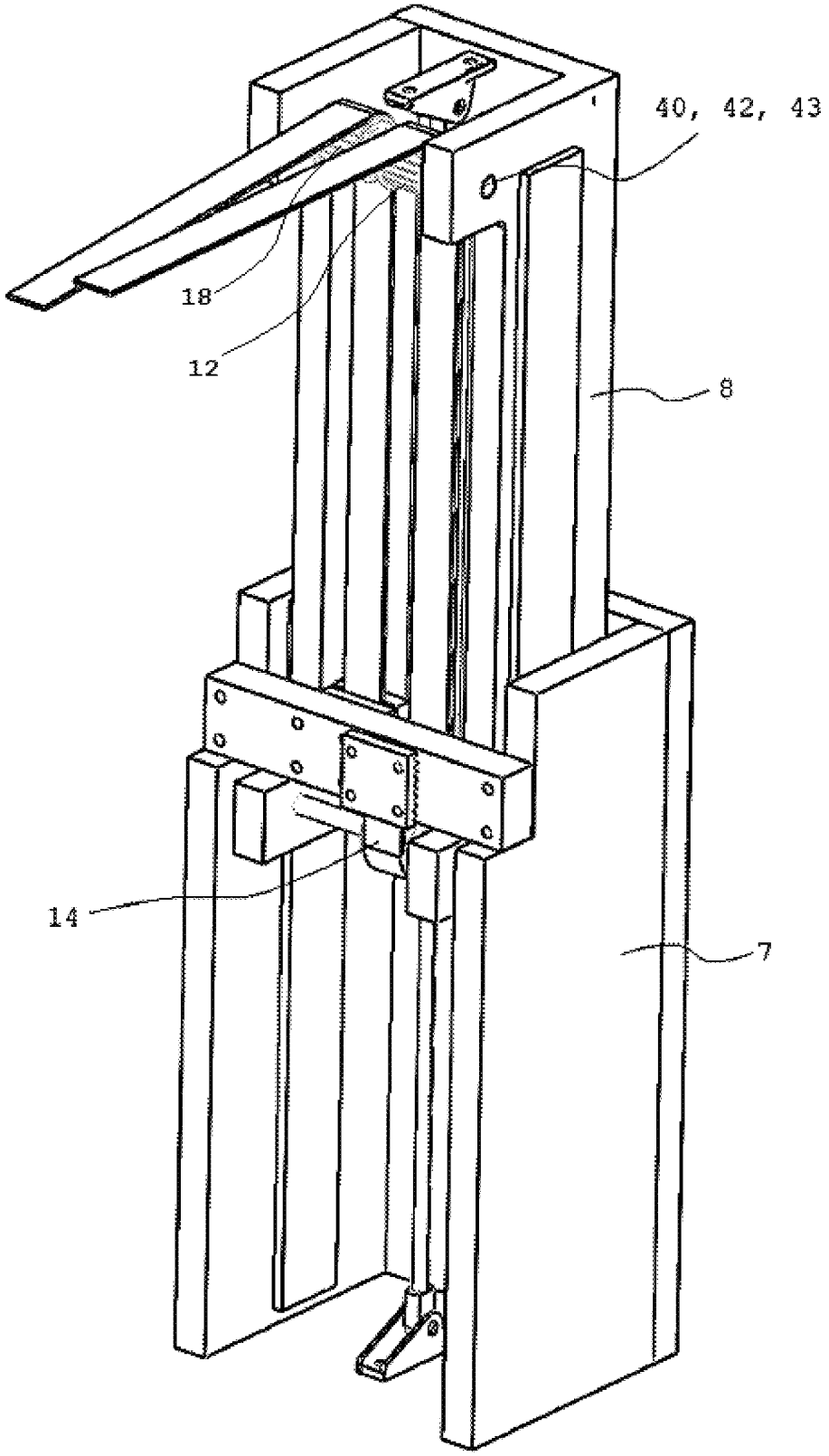
FIG. 4 is a schematic illustration of an embodiment of a redirection device in a lifting device.

In FIG. 4, an embodiment of a redirection device 11, 13 in a lifting device 2, 3 is illustrated, where the case illustrated is the second lifting device 3 with the redirection device 13. The first lifting device 2 with the redirection device 11 is constructed similarly thereto. The redirection device 13 includes a second front and rear redirection roller 12, 18 which are both movably arranged on an axle 40. The axle 40 is preferably rotatably arranged on the lifting element 8 via a bushing 42 and fixed by means of an adjustment ring 43. Alternatively, the axle 40 may also be connected in a rotationally secure manner, preferably by means of a transition fit, to the lifting device 3; on the rotationally secure axle 40, redirection rollers are then rotatably supported by means of bushings. The second pulling element 9 is redirected by a second lower redirection roller 14, again guided upwards and together with the first pulling element 6 secured to the second standing element 7 by means of a belt clamping plate which includes an auxiliary plate 44, a spacer piece 45 and a clamping plate 46.

Figure 5:
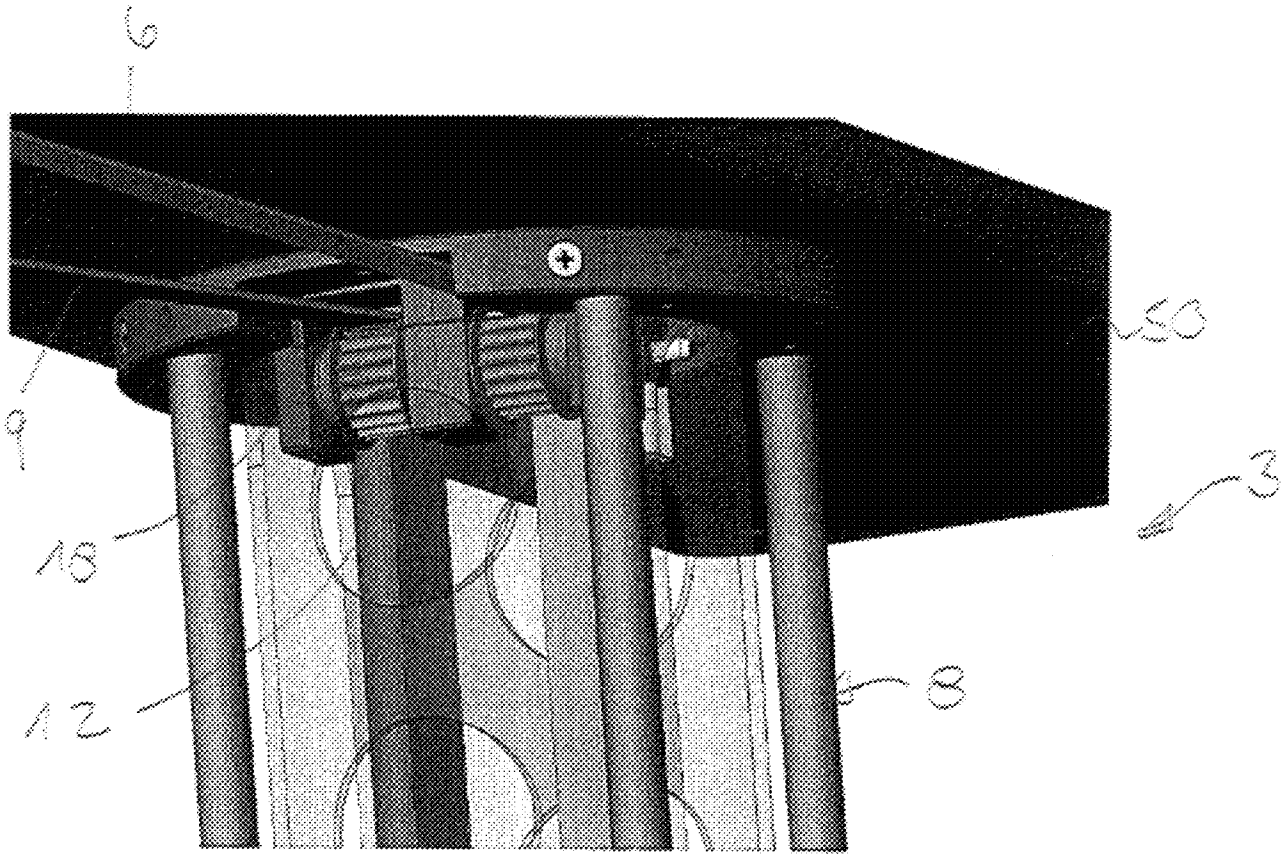
FIGS. 5-7 are schematic illustrations of an embodiment of a clamping device for clamping the pulling elements.
Figure 6:
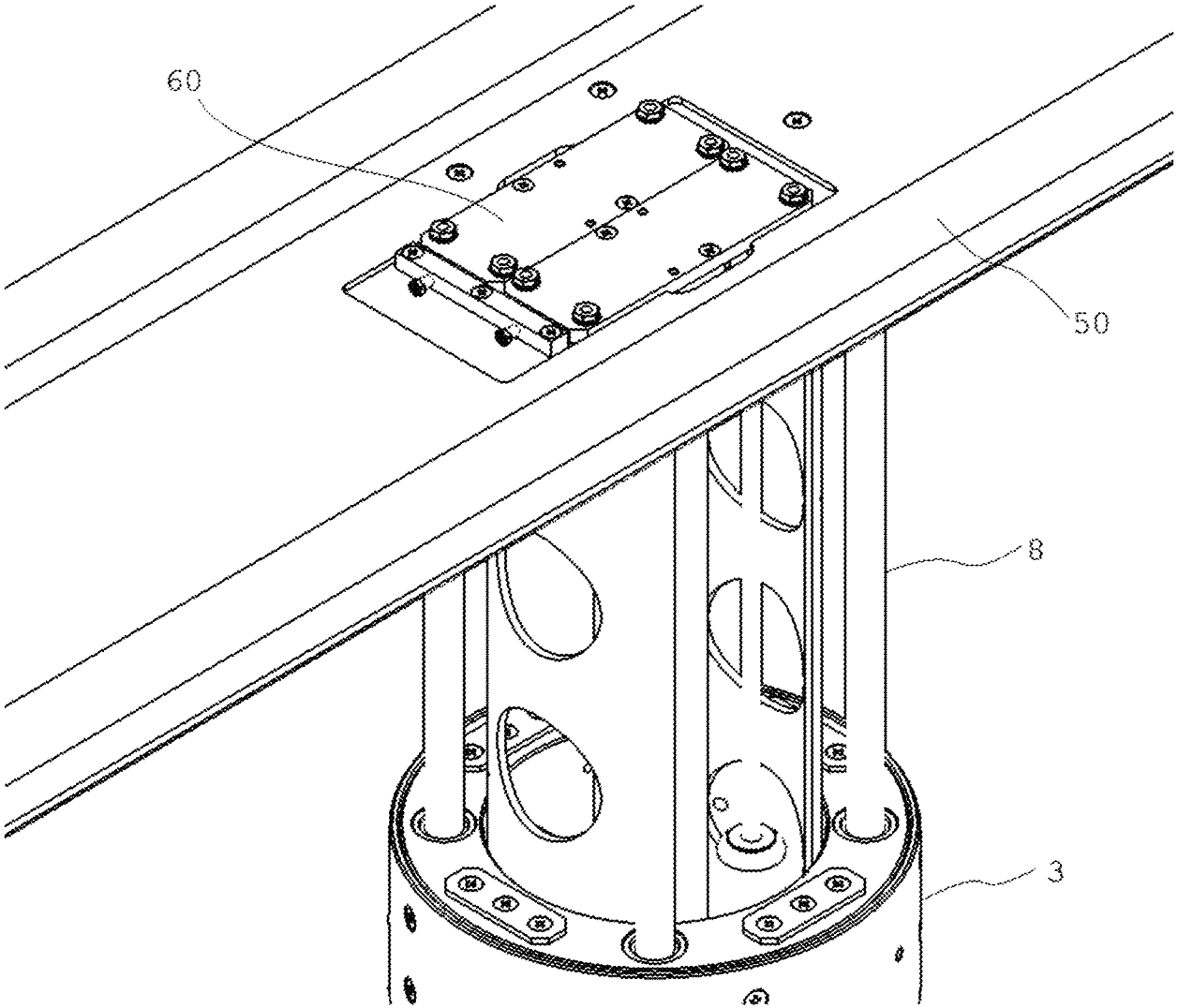
Figure 7:
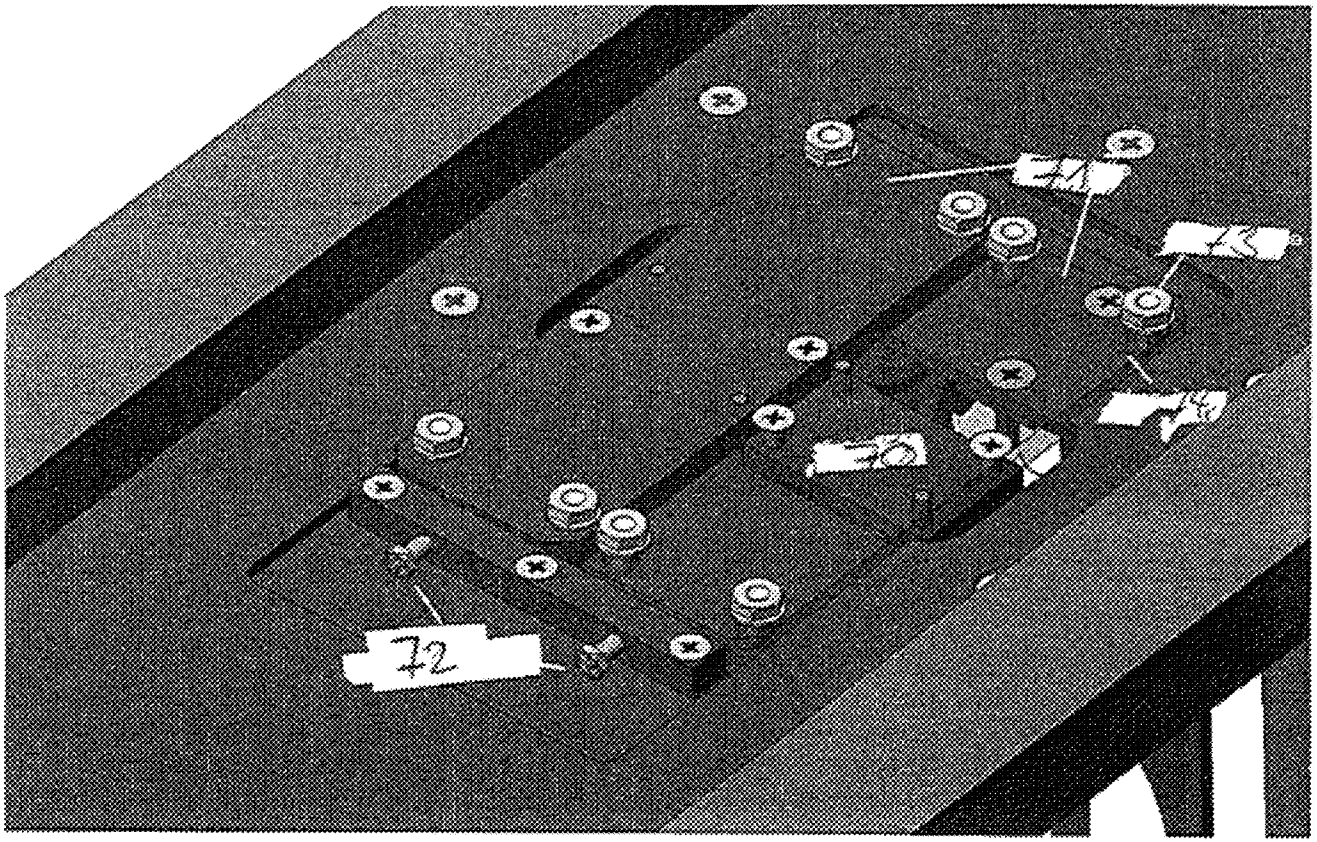

As a result of the positive-locking connection of the pulling elements 6, 9 to the central shaft 31, which is locked, all four part-pieces of the pulling elements 6, 9 should be individually clamped. An embodiment of a possible clamping device 60 can be derived from FIGS. 5, 6 and 7, which show the clamping device 60 on a second lifting device 3. For the first lifting device 2, the construction of the clamping device 60 is accordingly similar. In FIG. 5, the second lifting element 8 of the second lifting device 3 is illustrated. On the second lifting element 8, the second redirection rollers 12, 18 are arranged on the axle 40, via which the pulling elements 6, 9 are guided. The second lifting element 8 is secured to the cross-member 50. The cross-member 50 connects the first and second lifting device 2, 3 to each other. In addition, the locking device 26 is also secured to the cross-member 50. FIG. 6 illustrates that the cross-member 50 has above the securing to the second lifting device 3 an opening in which the clamping device 60 is arranged. As illustrated in FIG. 7 in greater detail, the clamping device 60 includes clamping blocks 70 which are connected to the upper redirection rollers 12, 18 (not illustrated). The clamping blocks 70 are received in clamping plates 71 and connected by means of retention screws 73. Via adjustment screws 72, there is produced a displacement of the clamping plates 71, where the clamping plates have short elongate holes 74 in which the retention screws 73 are guided. During inward adjustment relative to the securing device 26 the belt tension is decreased, in the event of outward adjustment the belt tension is increased.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A height-adjustable device, the height-adjustable device comprising:

at least two synchronously height-adjustable lifting devices, which each comprise a standing element and a lifting element, the lifting element being height-adjustable relative to the standing element;

pulling elements configured to carry out a height adjustment of the height-adjustable lifting devices, wherein:

each of the pulling elements is secured in a non-positive-locking manner or a positive-locking manner to two of the lifting devices, and is configured such that a lengthening in a region of a first lifting device, of the two lifting devices, brings about a synchronous shortening in a region of a second lifting device, of the two lifting devices, and each of the pulling elements is constructed to raise only the corresponding lifting element relative to the associated standing element;

redirection devices configured to raise the corresponding lifting element relative to the associated standing element for each of the lifting devices, and configured to guide the pulling elements; and a locking device configured to lock each of the pulling elements by a non-positive-locking engagement or a positive-locking engagement with the corresponding one of the pulling elements, wherein the locking device is configured to synchronise the movement of the pulling elements, wherein the locking device has a shaft for the non-positive-locking engagement or the positive-locking engagement, and for locking and synchronisation by engaging both of the pulling elements, and wherein the locking device comprises redirection rollers in a region of a forward offset or of a backward offset of the pulling elements arranged adjacent to the shaft, the redirection rollers being configured to secure the non-positive-locking engagement or the positive-locking engagement of the pulling elements to the shaft.

2. The device according to claim 1, wherein each end of each of the pulling elements is respectively connected in a non-positive-locking manner or a positive-locking manner to the corresponding standing element, and wherein a region of at least one of the lifting devices is guided by a pulley which is arranged on the respective lifting element, the redirection devices comprising the pulley.

3. The device according to claim 1, wherein the locking device is constructed for the non-positive-locking or the positive-locking engagement on each of the pulling elements in a region of a guide of the pulling elements between the lifting devices.

4. The device according to claim 1, wherein the locking device is configured to drive the pulling elements.

5. The device according to claim 1, wherein the pulling elements have toothed belts and the shaft has toothed wheels that mesh with the toothed belts.

6. The device according to claim 1, wherein the locking of the pulling elements is configured to be carried out by blocking a rotational movement of the shaft.

7. The device according to claim 1, wherein the redirection rollers comprise toothed wheels, effecting the positive locking with the pulling elements via direct engagement of teeth of the toothed wheels into openings of the pulling elements, the toothed wheels being connected to the shaft by a feather key connection.

8. The device according to claim 1, wherein the pulling elements are constructed in such a manner that during operation they are not subjected to lengthening.

9. The device according to claim 1, the at least two lifting devices comprising only the two lifting devices.

10. The device according to claim 1, the device being a table.

11. The device according to claim 10, wherein the locking device is constructed as a central unit below a table top between the lifting devices.

12. The device according to claim 1, the device comprising at least one device for receiving lifting loads.

13. The device according to claim 1, wherein the redirection rollers are rotateably supported on an axle.

14. The device according to claim 1, wherein the pulling elements comprise belts, bands, or chains.

15. The device according to claim 1, wherein the redirection rollers comprise friction wheels, effecting the non-positive locking via direct frictional engagement with the pulling elements, the friction wheels being connected to the shaft by a feather key connection.

* * * * *